US006000787A

United States Patent [19]

Weber et al.

[11] Patent Number: 6,000,787

[45] **Date of Patent: *Dec. 14, 1999**

[54] SOLID STATE INK JET PRINT HEAD

[75] Inventors: Timothy L. Weber, Corvallis, Oreg.; Kenneth E. Trueba, Barcelona, Spain; John Paul Harmon, Albany, Oreg.

[73] Assignee: Hewlett-Packard Company, Palo Alto, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/597,746

[22] Filed: Feb. 7, 1996

[51] Int. Cl.[6] ..... B41J 2/05

[52] U.S. Cl. ..... 347/65; 347/85; 347/93

[58] Field of Search ..... 347/65, 63, 93, 347/85, 47

[56] References Cited

U.S. PATENT DOCUMENTS

| | | | |
|---|---|---|---|
| 4,438,191 | 3/1984 | Cloutier et al. | 347/56 X |
| 4,502,060 | 2/1985 | Rankin et al. | 347/65 |
| 4,528,577 | 7/1985 | Cloutier et al. | 347/63 X |
| 4,550,326 | 10/1985 | Allen | 347/44 |
| 4,578,687 | 3/1986 | Cloutier et al. | 347/94 X |
| 4,680,859 | 7/1987 | Johnson | 347/56 X |
| 4,683,481 | 7/1987 | Johnson | 347/65 |
| 4,694,308 | 9/1987 | Chan et al. | 347/65 |
| 4,847,630 | 7/1989 | Bhaskar et al. | 347/63 |
| 4,864,329 | 9/1989 | Kneezel | 347/93 |
| 4,866,461 | 9/1989 | Piatt | 347/63 |
| 4,894,664 | 1/1990 | Tsung Pan | 347/63 |
| 4,896,171 | 1/1990 | Ito | 347/63 |
| 4,926,197 | 5/1990 | Childers | 347/63 |
| 5,194,877 | 3/1993 | Lam et al. | 347/63 |
| 5,204,690 | 4/1993 | Lorenze | 347/93 |
| 5,229,785 | 7/1993 | Leban | 347/63 X |
| 5,278,584 | 1/1994 | Keefe | 347/63 |
| 5,305,015 | 4/1994 | Schantz . | |
| 5,322,594 | 6/1994 | Bol | 347/65 X |
| 5,458,254 | 10/1995 | Miyagawa | 347/63 |

FOREIGN PATENT DOCUMENTS

| | | | |
|---|---|---|---|
| 1-190458 | 7/1989 | Japan | B41J 3/04 |

*Primary Examiner*—Joseph Hartary

[57] ABSTRACT

An ink jet print head having a substrate with an upper surface, and an ink supply conduit passing through the substrate. An array of independently addressable ink energizing elements are attached to the upper surface of the substrate. An orifice layer has a lower surface conformally connected to the upper surface of the substrate, and has an exterior surface facing away from the substrate. The orifice layer defines a plurality of firing chambers providing communication to the ink energizing elements, and each of the orifices is positioned in registration with a respective single ink energizing element. The exterior surface defines a plurality of nozzle apertures, each providing the upper terminus of a single firing chamber. Each of the firing chambers is laterally separated from all other firing chambers by a septum portion of the orifice layer.

29 Claims, 10 Drawing Sheets

FIG. 1
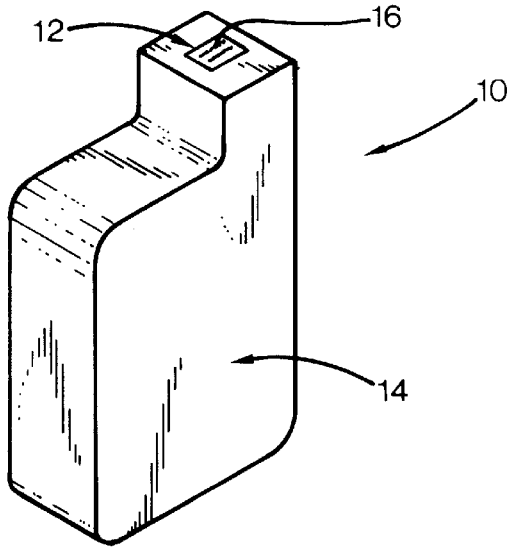
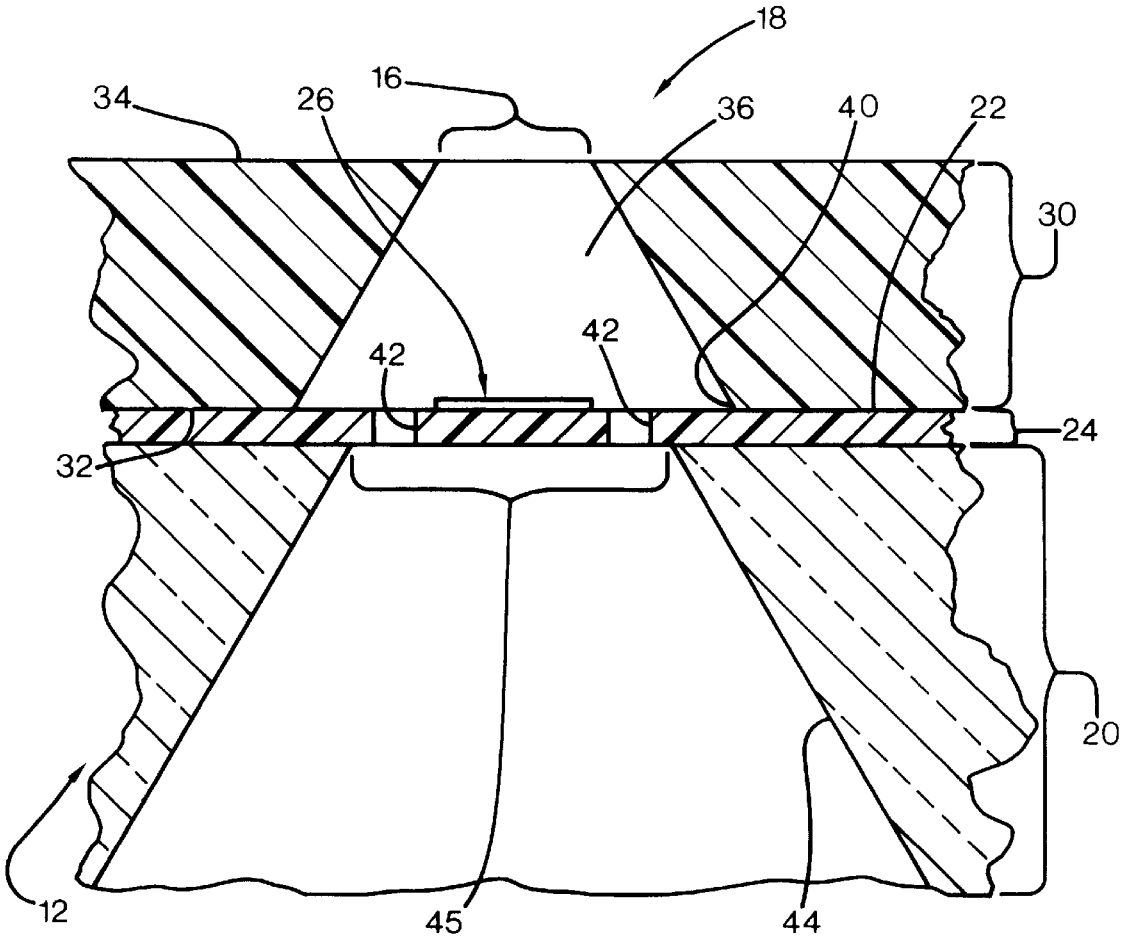
FIG. 2

SOLID STATE INK JET PRINT HEAD

FIELD OF THE INVENTION

This invention relates to ink jet printer pens, and more particularly to monolithic or solid state print heads.

BACKGROUND AND SUMMARY OF THE INVENTION

Ink jet printing mechanisms use pens that shoot droplets of colorant onto a printable surface to generate an image. Such mechanisms may be used in a wide variety of applications, including computer printers, plotters, copiers, and facsimile machines. For convenience, the concepts of the invention are discussed in the context of a printer. An ink jet printer typically includes a print head having a multitude of independently addressable firing units. Each firing unit includes an ink chamber connected to a common ink source, and to an ink outlet nozzle. A transducer within the chamber provides the impetus for expelling ink droplets through the nozzles.

To obtain high resolution printed output, it is desirable to maximize the density of the firing units, requiring miniaturization of print head components. When resolutions are sufficiently high, conventional manufacturing by assembling separately produced components becomes prohibitive. The substrate that supports firing resistors, the barrier that serves as a gasket to isolate individual resistors, and the orifice plate that provides a nozzle above each resistor are all subject to small dimensional variations that can accumulate to limit miniaturization. In addition, the assembly of such components for conventional print heads requires precision that limits manufacturing efficiency.

Monolithic print heads have been developed to provide a print head manufacturing process that uses photo imaging techniques similar to those used in semiconductor manufacturing. The components are constructed on a flat wafer by selectively adding and subtracting layers of various materials. Using photo-imaging techniques, dimensional variations are limited. Variations do not accumulate because each layer is registered to an original reference on the wafer. Existing monolithic print heads are manufactured by printing a mandrel layer of sacrificial material where firing chambers and ink conduits are desired, covering the mandrel with a shell material, then etching or dissolving the mandrel to provide a chamber defined by the shell. In the prior art, numerous firing chambers are interconnected as a single chamber, so that all may be fed by a single ink via drilled through the wafer into the chamber.

Existing monolithic print heads are complex to manufacture, and the interconnected nature of the ink chambers reduces the efficiency of ink expulsion. These disadvantages are overcome or reduced by providing an ink jet print head having a substrate with an upper surface, and an ink supply conduit passing through the substrate. An array of independently addressable ink energizing elements are attached to the upper surface of the substrate. An orifice layer has a lower surface conformally connected to the upper surface of the substrate, and has an exterior surface facing away from the substrate. The orifice layer defines a plurality of firing chambers, each passing through a respective nozzle aperture in the exterior surface, and extending downward through the orifice layer to expose a respective ink energizing element. Each of the firing chambers is separated from all other firing chambers by a portion of the orifice layer.

BRIEF DESCRIPTION OF THE DRAWINGS

FIG. 1 is perspective view of an ink jet pen having a print head according to a preferred embodiment of the invention.

FIG. 2 is an enlarged sectional side view of the print head of FIG. 1.

DETAILED DESCRIPTION OF A PREFERRED EMBODIMENT

Figure 3:
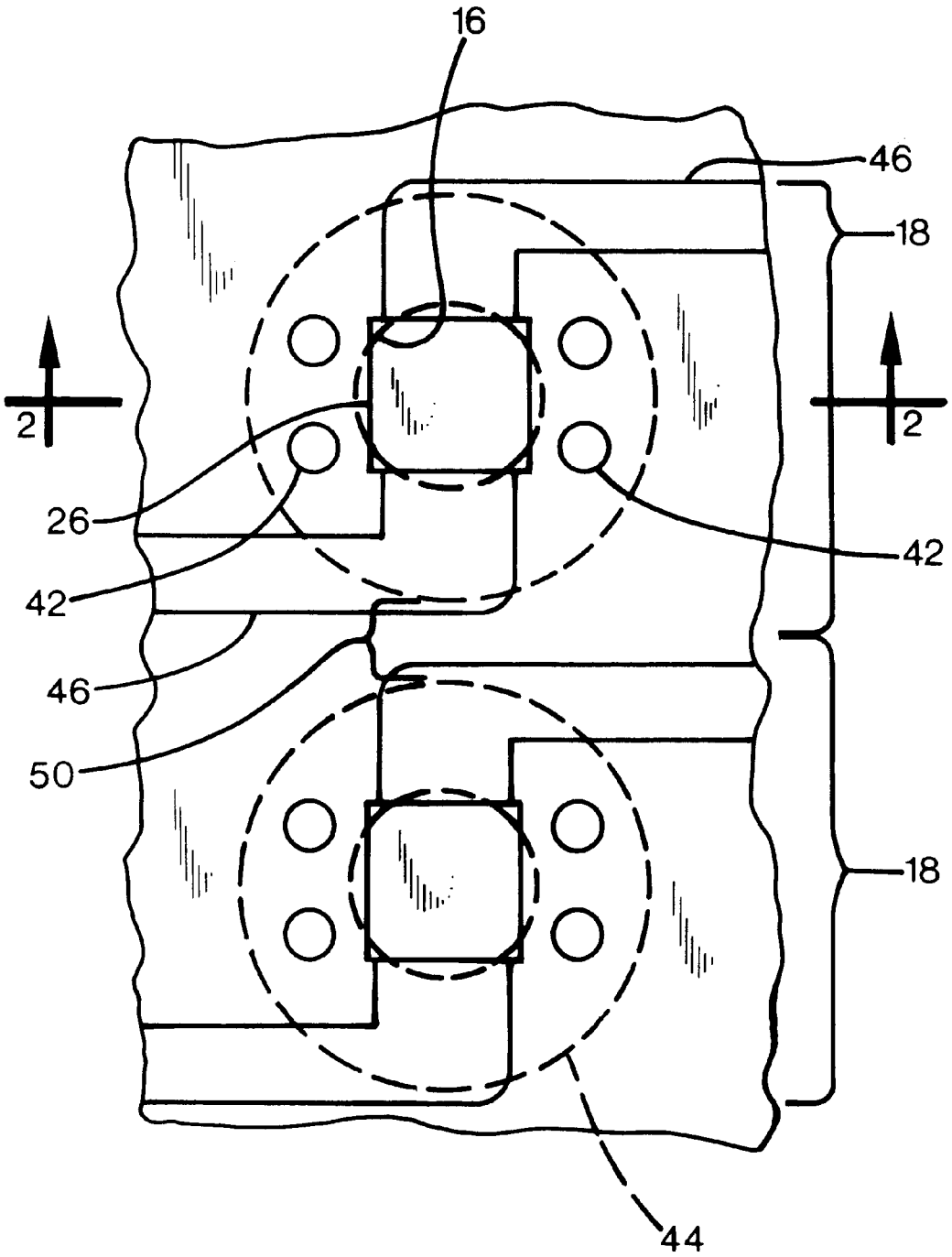
FIG. 3 is an enlarged top view of the embodiment of FIG. 2.

FIG. 1 shows a thermal ink jet pen 10 having a print head 12 according to a preferred embodiment of the invention. The pen includes a lower portion 14 containing an ink reservoir that communicates with the back or lower side of the print head in the orientation shown. The print head defines one or more linear arrays of orifices or nozzles 16 through which ink may be selectively expelled.

FIG. 2 shows a cross section of the print head 12 taken through an orifice 16 to illustrate a single firing unit 18. The print head includes a silicon substrate 20 that provides a rigid chassis for the print head, and which accounts for the majority of the thickness of the print head. The substrate has an upper surface 22 that is coated with a passivation layer 24 upon which rests a thin film resistor 26. An orifice layer 30 has a lower surface 32 that conformally rests atop the passivation layer, and has an exterior surface 34 that forms the uppermost surface of the print head, and which faces the material on which ink is to be printed.

The center point of the resistor 26 defines a normal axis on which the components of the firing unit 18 are aligned. The orifice layer 30 defines a frustoconical firing chamber 36 aligned on the resistor axis. The firing chamber has a larger circular base periphery 40 at the lower surface 32, and the smaller circular nozzle aperture 16 at the exterior surface. The passivation layer 24 defines several ink supply vias 42 dedicated to the single illustrated firing unit 18. The vias 42 are entirely encircled by the chamber's lower periphery 42, so that the ink they transmit is exclusively used by the one firing unit, and so that any pressure generated within the firing chamber will not generate ink flow to other chambers, except for the limited amount that may flow back through the vias, below the upper surface of the substrate. This prevents pressure "blow by" or "cross talk" from significantly affecting adjacent firing units, and prevents pressure leakage that might otherwise significantly reducing the expulsive force generated by a given amount of energy provided by the resistor. The use of more than a single via per firing unit provides redundant ink flow paths to prevent ink starvation of the firing unit by a single contaminant particle in the ink.

The substrate 20 defines a tapered trench 44, shown in end view, that is widest at the lower surface of the substrate to receive ink from the reservoir 14, and which narrows toward the passivation layer to a width greater than the domain of the ink vias 42. The cross sectional area of the trench is many times greater than the cross sectional area of the ink vias associated with a single firing unit, so that a multitude of such units may be supplied without significant flow resistance in the trench. The trench creates a void behind the resistor, leaving only a thin septum or sheet 45 of passivation material that separates the resistor from the ink within the trench. The thickness of this sheet 45 is less than the width of the resistor, preferably by a factor of 3 to 10. Consequently, rapid cooling of the resistor is provided, permitting the use of higher energy densities required by further miniaturization, and speeding the time required for the recondensation and collapse of the steam bubble normally generated in the chamber for the expulsion of each droplet.

In a variation on the embodiment of FIG. 2, the trench 44 is laterally offset from alignment with the firing chamber. Thus, the resistor 26 is entirely supported by the substrate 12, and is adjacent to the trench so that the firing chamber overlaps the upper portion of the trench to provide an ink flow path. While this reduces the liquid cooling effect discussed above, it provides additional mechanical stability for applications and materials requiring additional robustness.

As shown in FIG. 3, the vias 42 are distributed in a symmetrical rectangular pattern about the resistor 26, permitting conductive traces 46 to provide electrical contact to opposed edges of the square resistor. The adjacent firing chambers are spaced apart so that a solid septum 50 of orifice layer material separates the chambers; no ink may flow directly from one chamber to another above the upper surface of the substrate.

ALTERNATIVE EMBODIMENTS

Figure 4:
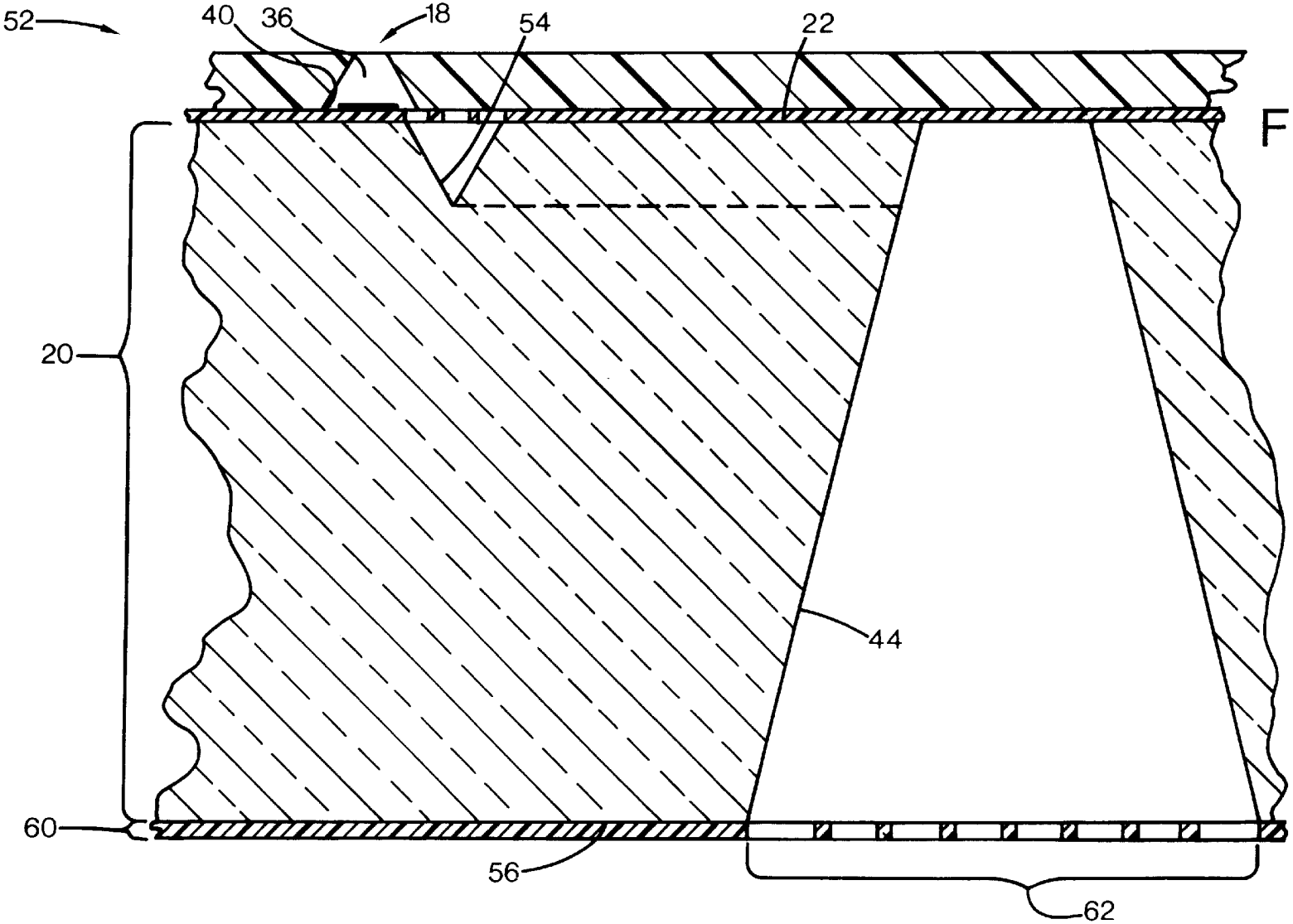
FIG. 4 is a sectional side view of an alternative embodiment of the invention.

FIG. 4 shows an alternative embodiment print head 52 in which the ink trench 44 is offset well away from the firing unit 18. An ink conduit system including a network of channels 54 extends laterally below the upper surface 22 of the substrate 20 from the upper portion of the trench 44 to each respective firing chamber. The channel has a V-shaped cross section as provided by anisotropic etching of the silicon substrate, and the widest upper opening of the channel overlaps slightly with the lower periphery 40 of the firing chamber 36. The overlap has a crescent shape defined by the arc of the lower periphery and the straight edge of the channel 54.

The substrate 20 has a lower surface 56 that is coated with a lower passivation layer 60. The lower passivation layer 60 defines a perforated region 62 corresponding to the widest lower opening of the trench 44. This permits ink to flow into the trench, while functioning as a mesh filter to prevent particles from entering the ink conduit system of channels. The same lower perforated mesh system is also employed in the preferred embodiment.

Figure 5:
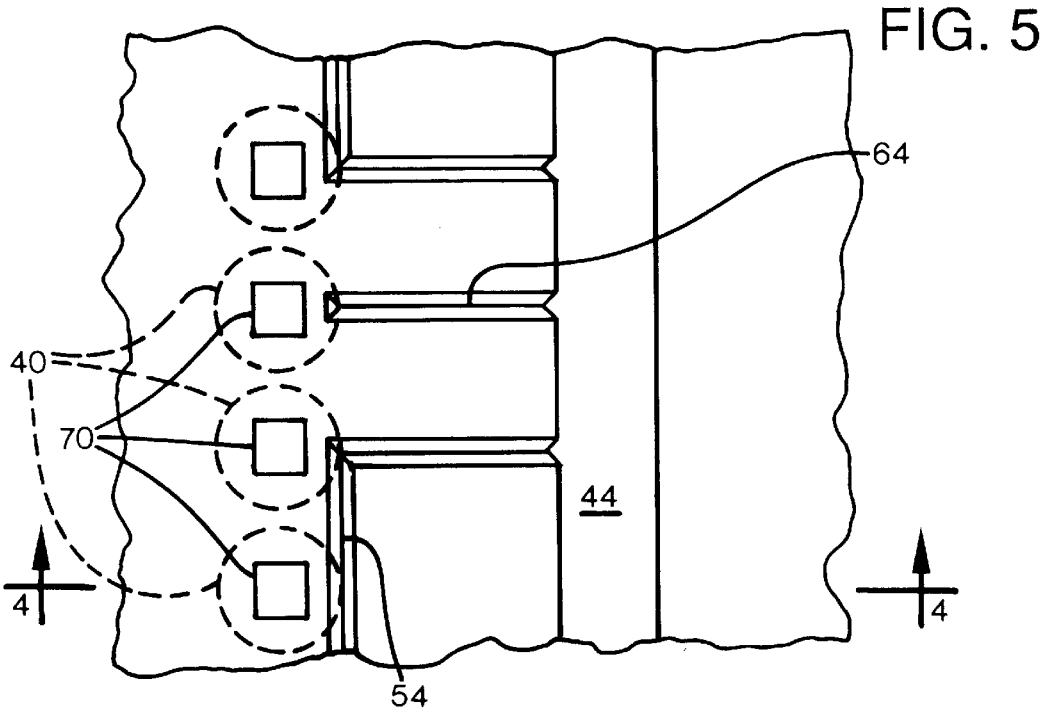
FIG. 5 is a top view of the embodiment of FIG. 4 with layers removed for clarity.
Figure 6:
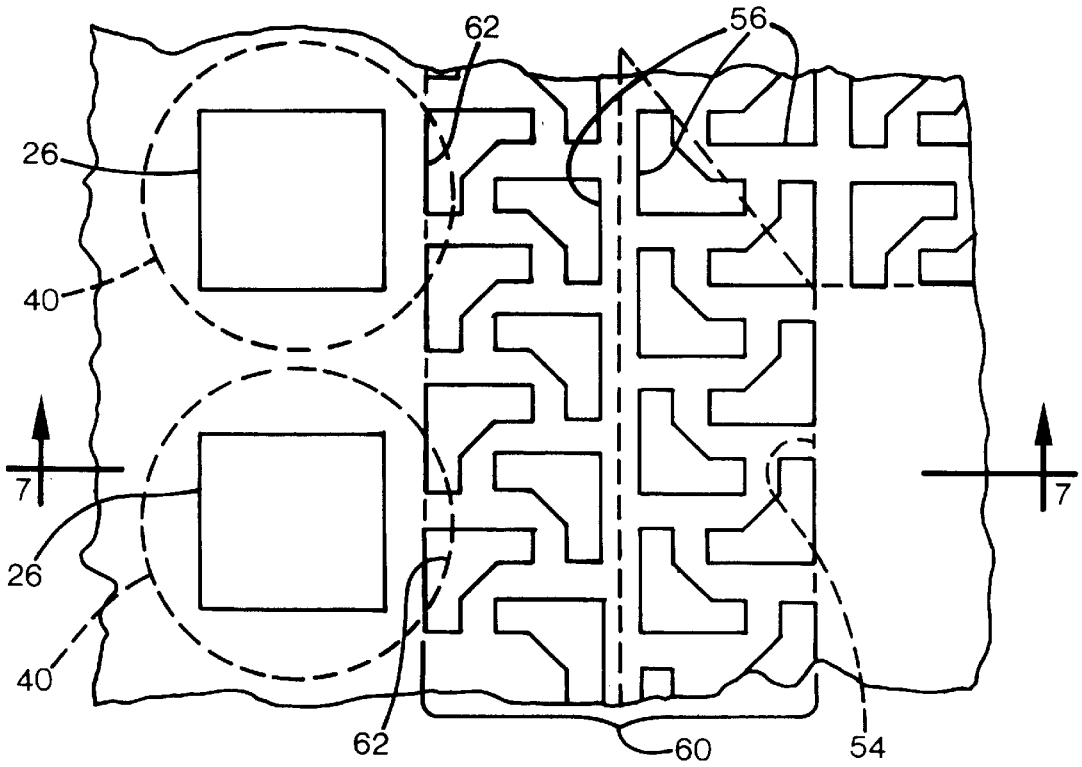
FIG. 6 is an enlarged top view of the embodiment of FIG. 4.

As shown in FIG. 5, either a single channel 54 may serve more than one resistor 26, or a dedicated channel 64 may be provided for each of some or all of the resistors, or a mixture of both types may be used in a single print head. FIG. 6 shows channel 54 adjacent two resistors 26. The passivation layer is perforated with a closely packed swath or array of L-shaped or wedge-shaped openings 56 forming a mesh 60 coextensive with the upper opening of the channel. The mesh region in part defines the crescent shaped overlaps 62 as discussed above with respect to FIG. 4. Each overlap preferably includes portions of at least two perforations, so that ink flow redundancy is provided. Because the channels are etched through the perforations, the perforations have bent, elongated shapes, with at least one end of each perforation occupying the space nestled between the "arms" of an adjacent perforation, so that the undercutting effects of anisotropic etching will etch the channel beneath the entire swath of perforations.

Figure 7:
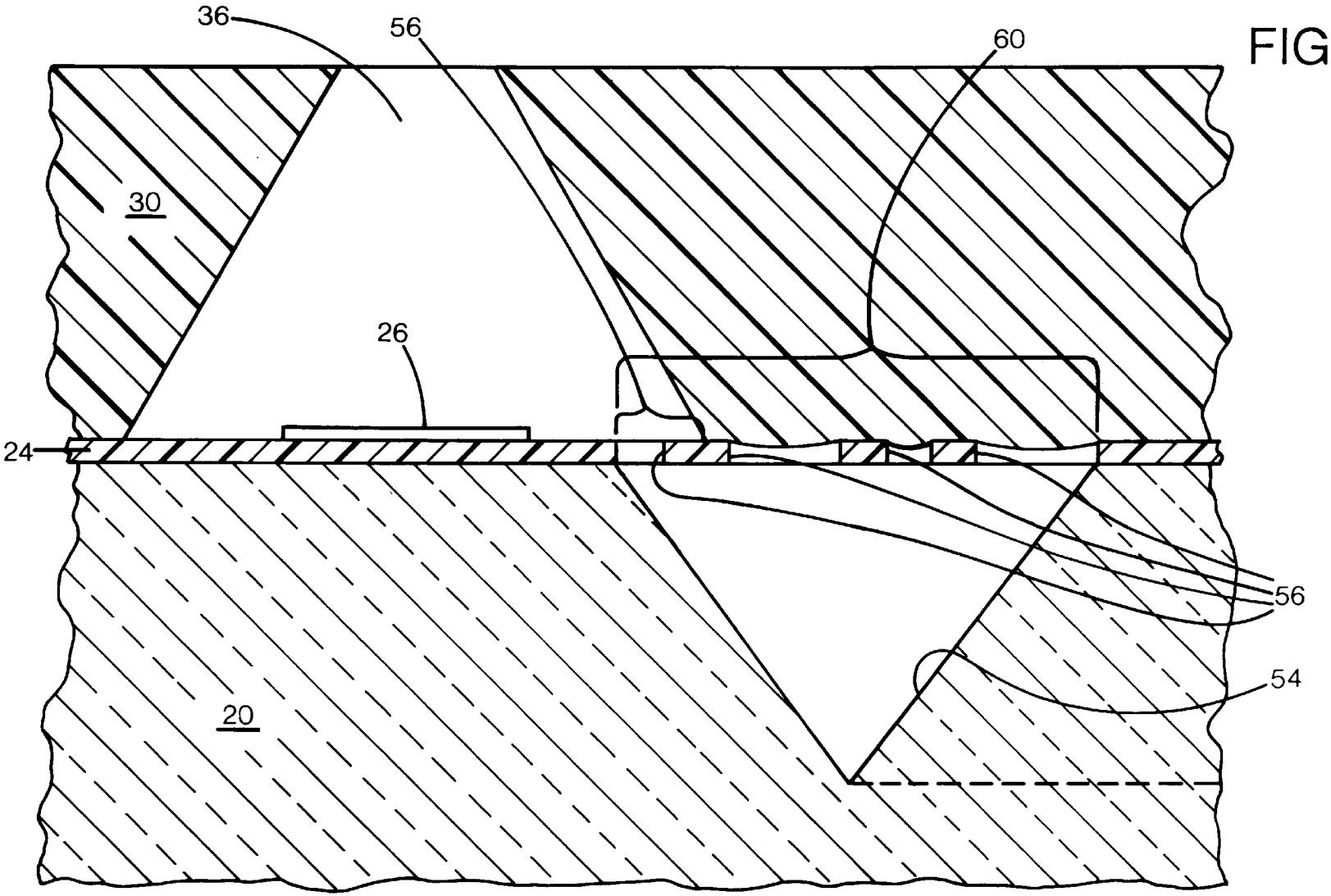
FIG. 7 is an enlarged sectional side view of the FIG. 5.

FIG. 7 shows how the mesh 60 provides support for the orifice layer 30. As will be discussed below, the orifice layer is applied as a viscous liquid or flexible film to the passivation-coated substrate, and thus may "sag" into an open channel. However, the perforations 56 are sufficiently small that the viscosity and/or surface tension of the orifice layer prevent it from entering and obstructing the channel 54. A minimal sag is illustrated.

In either embodiment, The substrate 20 is a silicon wafer about 675 $\mu$m thick, although glass or a stable polymer may be substituted. The passivation layer 24 is formed of silicon dioxide, silicon nitride, silicon carbide, tantalum, poly silicon glass, or other functionally equivalent material having different etchant sensitivity than the substrate, with a thickness of about 3 $\mu$m. The vias 42 have a diameter about equal to or somewhat larger than the thickness of the passivation layer. The orifice layer has a thickness of about 10 to 30 $\mu$m, the nozzle aperture 16 has a similar diameter, and the lower periphery of the firing chamber has a diameter about double the width of the resistor 26, which is a square 10 to 30 $\mu$m on a side. The typical width of an arm of one of the mesh perforations is 12 $\mu$m, and the typical width of the bridges of material forming the mesh between perforations is 6 $\mu$m. The anisotropic etch of the silicon substrate provides a wall angle of 54° from the plane of the substrate, providing a nearly equilateral cross section in the V-shaped channel. Although isotropic etching may be used, the semi cylindrical or hemispherical channels that result are less resistant to clogging by an unexpectedly sagging portion of the orifice layer, and are less effective at wicking ink than is the sharp groove of the illustrated embodiments.

METHOD OF MANUFACTURE

Figure 8A:
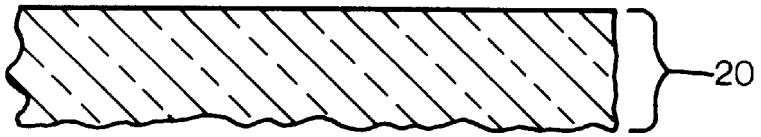
FIGS. 8A–8H and 8E'–8G' illustrate preferred and alternative sequences of manufacturing the preferred embodiment of FIG. 2.
Figure 8B:
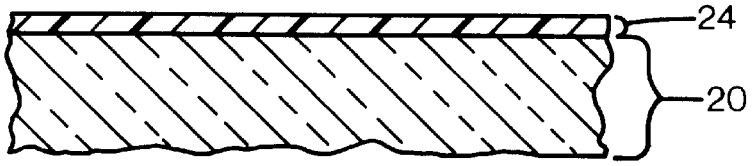
Figure 8C:
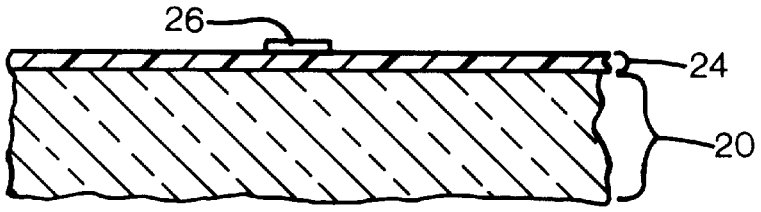
Figure 8D:
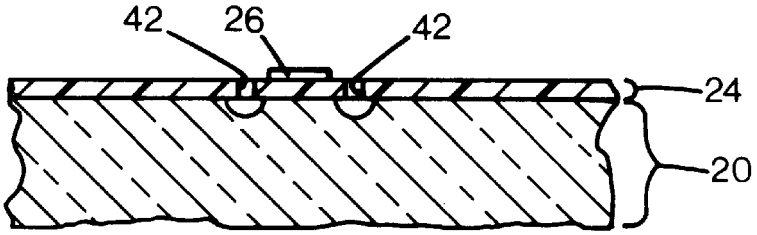

FIGS. 8A, B, C, D, E, H, and I show a first sequence of manufacture of the embodiment of FIG. 2. A silicon wafer substrate 20 is provided in FIG. 8A, the passivation layer 24 is applied to the entire wafer in FIG. 8B, and the resistor 26 and conductive traces (not shown) are applied in FIG. 8C. An alternative to application of the passivation layer as a different material is to process the wafer's upper surface to convert the upper portion of the wafer to a chemically or physically different compound that resists the etchant to be used in the next step. In FIG. 8D, the vias 42 are etched by an anisotropic process, although the process is isotropic below the passivation layer, which results in enclosed hemispherical etched portions of the substrate below the vias. Alternatively, the vias may be laser drilled or formed by any other suitable means.

Figure 8E:
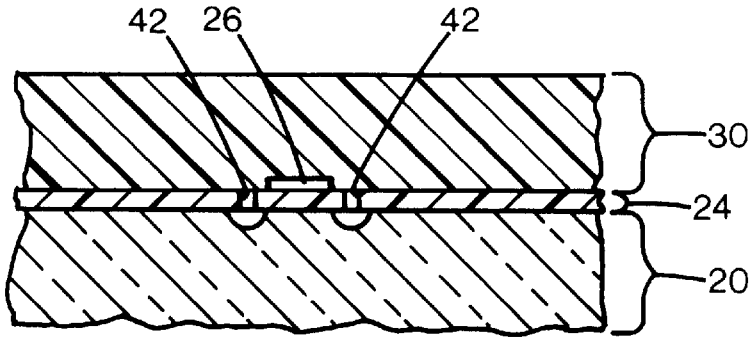

The orifice layer 30 is applied in FIG. 8E. It may be laminated, screened, or "spun" on by pouring liquid material onto a spinning wafer to provide a uniform thickness of material that contacts and conforms to essentially the entire region near the firing chambers to prevent voids between chambers through which ink might leak. The orifice layer may be selectively applied to portions of each print head on the wafer, or may preferably be applied over the entire wafer surface to simplify processing.

Figure 8H:
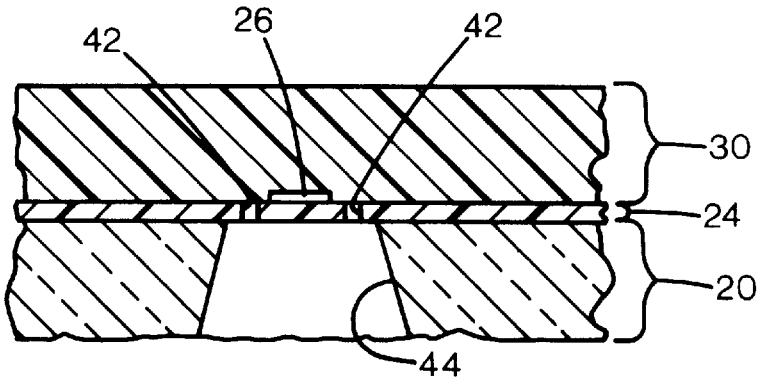

In FIG. 8H, the ink trench 44 is etched by anisotropic etching to form the angled profile. Prior to this, the lower surface of the wafer may be coated with a passivation layer that is selectively applied with open regions or a mesh region 62 (as shown in FIG. 4) where the trench is to be located.

The etching of the trench would then proceed through the mesh, until the rear of the passivation layer is exposed, and the vias 42 are in communication with the trench.

Figure 8I:
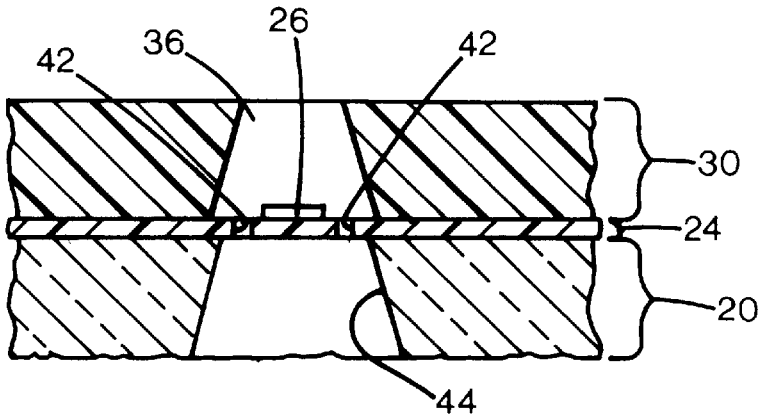
Figure 8E:
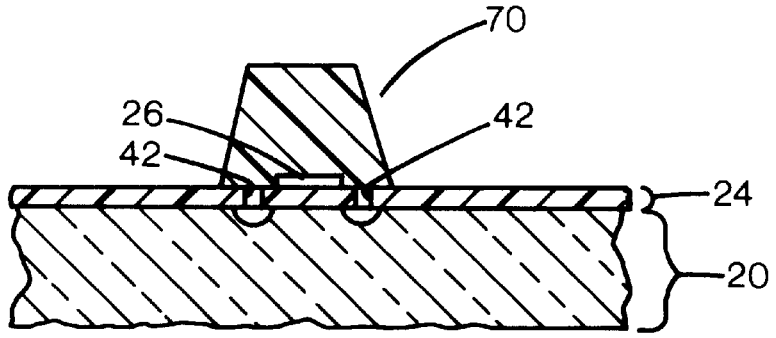

As shown in FIG. 8I, the firing chamber 36 is formed by conventional means: 1) the orifice layer may be applied in sequential layer portions having progressively increasing resistance to etching as their distance from the substrate increases; etching will occur more rapidly at the less robust lower portions; 2) the aggressiveness of the etchant may be increased progressively during the process to provide the undercut of a uniform orifice layer; 3) a photo defined process may be used wherein a resistive layer is applied to the surface of the orifice layer, and an energy source is shone at an angle from normal to the surface while the wafer is rotated, providing the tapered shape; or 4) other conventional chemical or mechanical means. In alternative embodiments, the firing chamber may have a cylindrical or alternative profile deemed suitable for ink jet printing, without departing from the concepts of the invention.

Finally, the wafer is separated into individual print heads, which are attached to respective ink jet pens 10 as shown in FIG. 1 in communication with the ink supply.

Figure 8F:
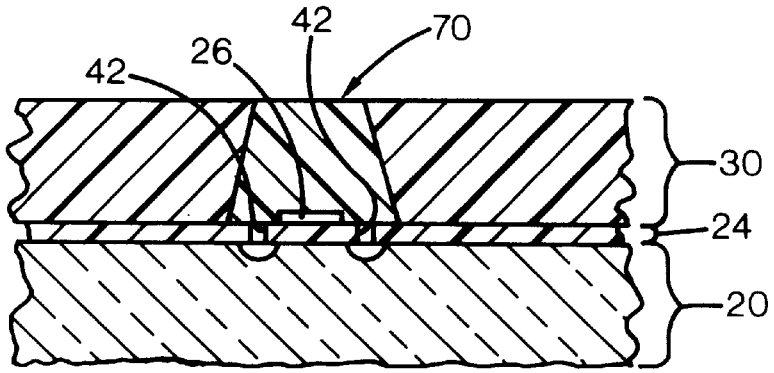
Figure 8G:
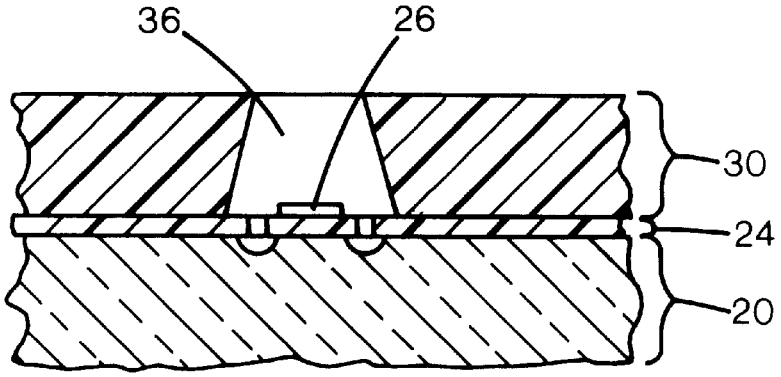

A second sequence of manufacture of the embodiment of FIG. 2 is shown in FIGS. 8A, B, C, D, E', F', G', and H. Essentially, Step 8E is replaced by steps 8E', 8F', and 8G', and step 8I is eliminated. Instead of forming a solid orifice layer and removing material, a tapered frustoconical mandrel 70 is formed over each resistor 26 in the shape of the desired firing chamber, as shown in FIG. 8E'. In FIG. 8F', the orifice layer is applied to the wafer surface to a thickness flush with the upper surface of the mandrel. In FIG. 8G', the mandrel of sacrificial material is etched or dissolved from the orifice layer, leaving the remaining chamber. Processing continues with the etching of trench 44, as discussed above with respect to FIG. 8H. As an alternative, the trench 44 may be etched prior to etching the mandrel 70.

Figure 9A:
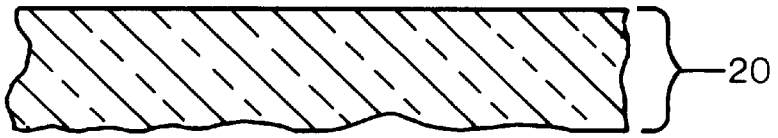
FIGS. 9A–9G illustrate a sequence of manufacturing the alternative embodiment of FIG. 4.
Figure 9B:
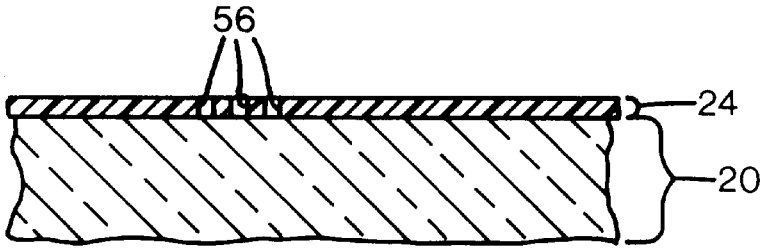
Figure 9C:
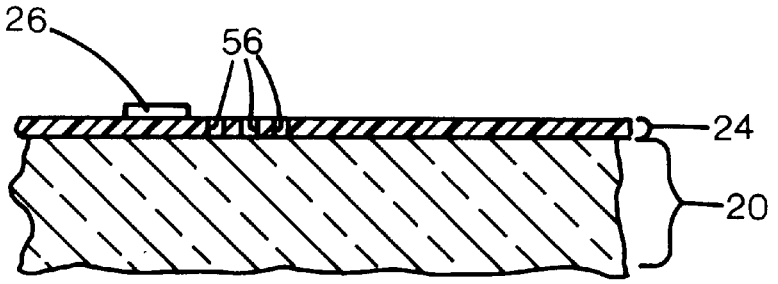
Figure 9D:
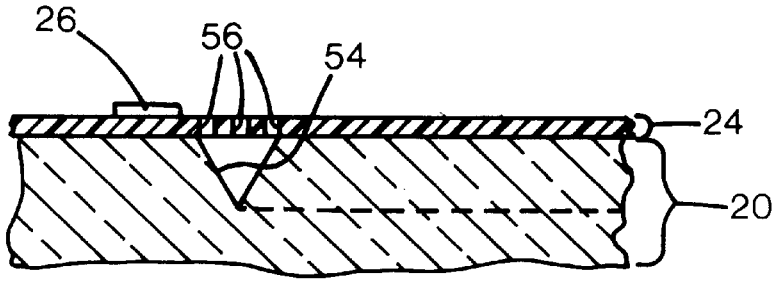
Figure 9E:
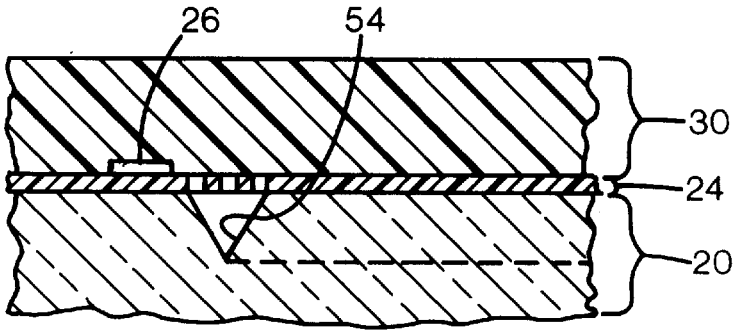
Figure 9F:
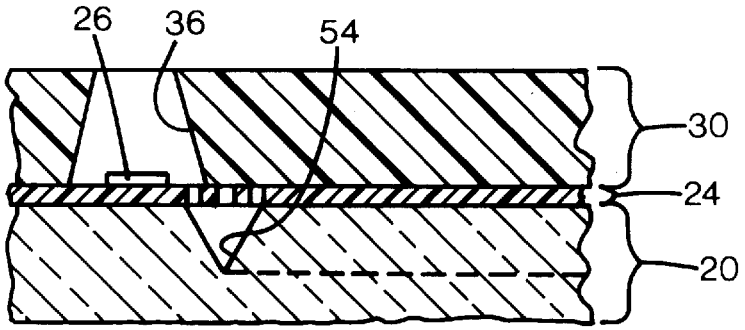
Figure 9G:
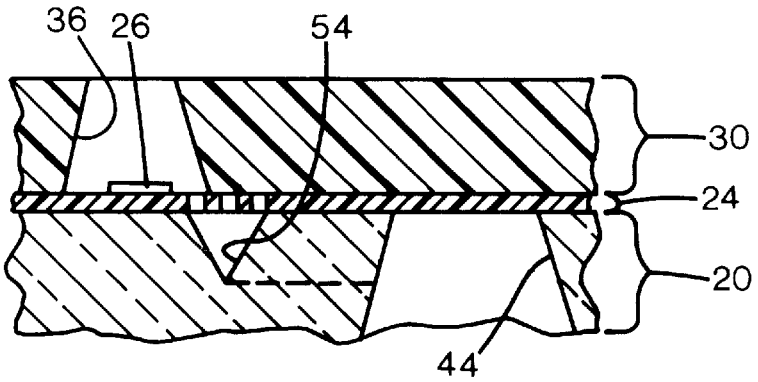

A third sequence of manufacture is shown in FIGS. 9A–9G, and is used to produce the embodiment of FIG. 4. FIG. 9A shows the substrate 20, and the passivation layer 24 is added in FIG. 9B, with perforations 56 exposing portions of the substrate where channels are to be etched. The resistor 26 is laid down in FIG. 9C, and the groove 54 is etched through the perforations, as shown in FIG. 9D. The orifice layer 30 is applied in FIG. 9E, and the firing chambers are formed in FIG. 9F, either by the methods discussed above with respect to FIG. 8I or FIGS. 8E'–8G'. The ink trench 44 is etched from the back side of the wafer in FIG. 9G, until it encounters the channels 54, providing flow of ink to the firing chambers. The trench etching may be preceded by the formation of a passivation mesh as discussed above with respect to FIG. 8H. In all the illustrated embodiments, the manufacturing processes are conducted simultaneously for a multitude of print heads on a single wafer, providing productive and cost effective production.

While the above disclosure is discussed in terms of various embodiments, the invention may be modified without departing from the disclosed principles. In particular, the orientational references in the text and drawings are provided only for clarity and consistency; the disclosed embodiments may be manufactured and operated effectively in any orientation.

We claim:

1. An ink jet print head comprising:

a substrate having an upper surface, and defining an ink supply conduit;

an array of independently addressable ink energizing elements attached to the upper surface of the substrate;

an orifice layer formed of a single material having a lower surface conformally connected to the upper surface of the substrate, and an exterior surface facing away from the substrate, the orifice layer defining a plurality of firing chambers, each firing chamber opening through a respective nozzle aperture in the exterior surface, and extending downward through the orifice layer to expose a respective ink energizing element; and each of at least some of the firing chambers being laterally separated from all other firing chambers by a portion of the orifice layer, such that the firing chambers are not laterally interconnected.

2. The ink jet print head of claim 1 wherein each of at least some of the firing chambers includes:

a floor defined by a portion of the upper surface of the substrate and including a single ink energizing element, a frustoconical wall encompassing the ink energizing element and extending generally upward from the upper surface of the substrate, and the nozzle aperture being defined at the intersection of the wall and the exterior surface of the orifice layer.

3. The ink jet print head of claim 2 wherein the wall is a continuous and smooth surface between the substrate upper surface and the orifice layer exterior surface, such that ink is not admitted to or emitted from the firing chamber except through the floor or the nozzle.

4. The ink jet print head of claim 1 wherein the ink supply conduit includes a plurality of inlet apertures in the plane of the upper surface of the substrate, each inlet aperture providing ink communication with a single firing chamber.

5. The ink jet print head of claim 4 wherein at least some of the firing chambers each include a plurality of inlet apertures, such that redundant flow is provided to avoid clogging by a single particle in the ink.

6. The ink jet print head of claim 1 wherein the ink supply conduit is located below the upper surface of the substrate and includes:

an ink manifold defined at least in part by the substrate, and a plurality of ink passages, each passage extending between the manifold and at least a single firing chamber.

7. The ink jet print head of claim 6 wherein a portion of the manifold is positioned within the substrate directly beneath at least a portion of each of at least some of the ink energizing elements, and wherein each of at least some of the ink passages are positioned adjacent to a respective ink energizing element and extends between said portion of the manifold and the firing chamber.

8. The ink jet print head of claim 7 wherein the substrate includes a septum between the manifold portion and the firing chamber, the septum having a thickness of less than 5 $\mu$m, such that ink within the manifold portion may readily conduct heat from the septum.

9. The ink jet print head of claim 7 wherein the substrate includes a septum between the manifold portion and the firing chamber, the septum having an unsupported span at least three times as great as its thickness, such that ink within the manifold portion may readily conduct heat from the septum.

10. The ink jet print head of claim 1 wherein the ink supply conduit includes a plurality of channel segments defined in the substrate along the upper surface of the substrate, each of at least some of the channel segments having an aperture portion extending into a firing chamber, a supply portion connected to a supply of ink, and a transmission portion enclosed at the upper surface of the substrate by a portion of the orifice layer.

11. The ink jet print head of claim 10 wherein at least selected portions of at least some of the channel segments extend laterally through the substrate.

12. The ink jet print head of claim 1 wherein the ink energizing elements are resistors.

13. The ink jet print head of claim 1 wherein the upper surface of the substrate includes an upper layer having different chemical properties than the remainder of the substrate, such that the upper layer is resistant to an etchant effective to etch the remainder of the substrate, the upper layer defining at least a single perforation within each of at least some of the firing chambers.

14. The ink jet print head of claim 13 wherein at least a first portion of the ink conduit is defined by a perforated portion of the upper layer, and wherein at least some of the first portion is covered by the orifice layer, such that the first portion may be etched through the perforations, and whereby the perforations prevent substantial incursion of the orifice layer into the first portion of the ink conduit.

15. The ink jet print head of claim 13 wherein the upper layer defines a plurality of perforations within each firing chamber, such that redundant flows paths are provided to avoid clogging by a single contaminant particle in the ink.

16. The ink jet print head of claim 1 wherein the substrate has a lower surface coated with a lower layer defining a plurality of perforations in a perforated region coextensive with a portion of the ink conduit.

17. An ink jet print head comprising:

a substrate having a base of a first material and an upper layer of a second material defining a plurality of perforations, the upper layer having an upper surface away from the base, the base having a lower surface opposite the upper surface, and the base at least in part defining an ink supply conduit below the surface;

an array of independently addressable ink energizing elements attached to the upper surface;

an orifice layer formed of a single material having a lower surface conformally connected to the upper surface and an exterior surface facing away from the substrate, the orifice layer defining a plurality of firing chambers, each passing through a respective nozzle aperture in the exterior surface, and extending downward through the orifice layer to expose a respective ink energizing element;

the orifice layer single material defining a wall surface extending from the orifice to the substrate such that each chamber is defined laterally entirely by the orifice layer material;

each firing chamber having a smaller encompassed area at the orifice than at the substrate; and each of at least some of the firing chambers being separated from all other firing chambers by a septum portion of the orifice layer.

18. The ink jet print head of claim 17 wherein the upper layer defines a plurality of perforations in each firing chamber.

19. The ink jet print head of claim 17 wherein the ink supply conduit at least in part includes a cavity extending from the lower surface of the substrate to an unsupported portion of the upper layer coextensive with at least a portion of a resistor, such that the unsupported portion is exposed to the cavity, and wherein the unsupported portion spans a distance at least three times as great as its thickness, such that it readily conducts heat from the upper surface of the upper layer to the lower surface.

20. The ink jet print head of claim 17 wherein the upper layer includes a plurality of paths populated with perforations, and wherein the ink supply conduit includes channels defined at least in part by the substrate, and positioned immediately below the paths.

21. The ink jet print head of claim 17 wherein the substrate includes a lower layer of the second material, and defines a plurality of perforations over an inlet region comprising a portion of the ink supply conduit, such that the perforated inlet region functions as a mesh filter to prevent particles from entering the ink supply conduit.

22. The ink jet print head of claim 17 wherein the unsupported portion has a thickness of less than 5 $\mu$m.

23. An ink jet print head comprising:

a substrate having an upper surface, and defining an ink supply conduit located below the upper surface of the substrate;

an array of independently addressable ink energizing elements attached to the upper surface of the substrate;

an orifice layer having a lower surface conformally connected to the upper surface of the substrate, and an exterior surface facing away from the substrate, the orifice layer defining a plurality of firing chambers, each firing chamber opening through a respective nozzle aperture in the exterior surface, and extending downward through the orifice layer to expose a respective ink energizing element;

each of at least some of the firing chambers being laterally separated from all other firing chambers by a portion of the orifice layer, such that the firing chambers are not laterally interconnected;

an ink manifold defined at least in part by the substrate;

a plurality of ink passages, each passage extending between the manifold and at least a single firing chamber;

the substrate including an unsupported septum between the manifold and the firing chamber, the septum having a width at least three times as great as its thickness, such that ink within the manifold portion may readily conduct heat from the septum.

24. The ink jet print head of claim 23 wherein the septum has a thickness less than 5 $\mu$m.

25. The ink jet print head of claim 23 wherein the orifice layer is formed of a single material.

26. The ink jet print head of claim 23 wherein the firing chamber has a frustoconical shape.

27. The ink jet print head of claim 23 wherein the ink supply conduit includes a plurality of channel segments defined in the substrate along the upper surface of the substrate, each of at least some of the channel segments having an aperture portion extending into a firing chamber, a supply portion connected to a supply of ink, and a transmission portion enclosed at the upper surface of the substrate by a portion of the orifice layer.

28. The ink jet print head of claim 27 wherein at least selected portions of at least some of the channel segments extend laterally through the substrate.

29. The ink jet print head of claim 23 wherein the substrate has a lower surface coated with a lower layer defining a plurality of perforations in a perforated region coextensive with a portion of the ink conduit.

* * * * *